US005583907A

United States Patent [19]

Ono et al.

[11] Patent Number: 5,583,907

[45] Date of Patent: Dec. 10, 1996

[54] ROTARY ANODE TYPE X-RAY TUBE AND METHOD OF MANUFACTURING THE SAME

[75] Inventors: Katsuhiro Ono, Utsunomiya; Hidero Anno, Otawara; Hiroyuki Sugiura; Takayuki Kitami, both of Tochigi-ken, all of Japan

[73] Assignee: Kabushiki Kaisha Toshiba, Kawasaki, Japan

[21] Appl. No.: 542,949

[22] Filed: Oct. 13, 1995

[30] Foreign Application Priority Data

Oct. 13, 1994 [JP] Japan ..... 6-247373

[51] Int. Cl.[6] ..... H01J 35/10

[52] U.S. Cl. ..... 378/132; 378/133

[58] Field of Search ..... 378/132, 133

[56] References Cited

U.S. PATENT DOCUMENTS

| | | | |
|---|---|---|---|
| 4,210,371 | 7/1980 | Gerkema et al. | 308/9 |
| 4,562,587 | 12/1985 | Gerkema et al. | 378/133 |
| 4,641,332 | 2/1987 | Gerkema | 378/125 |
| 4,856,039 | 8/1989 | Roelandse et al. | 378/133 |
| 5,068,885 | 11/1991 | Vetter | 378/133 |
| 5,077,776 | 12/1991 | Vetter | 378/133 |
| 5,189,688 | 2/1993 | Ono | 378/132 |
| 5,195,119 | 3/1993 | Ono et al. | 378/133 |
| 5,210,781 | 5/1993 | Ono et al. | 378/125 |

FOREIGN PATENT DOCUMENTS

| | | |
|---|---|---|
| 0479195 | 4/1992 | European Pat. Off. . |
| 0479198 | 4/1992 | European Pat. Off. . |
| 0562808 | 7/1993 | European Pat. Off. . |
| 4-149940 | 5/1992 | Japan . |

*Primary Examiner*—Craig E. Church
*Attorney, Agent, or Firm*—Cushman Darby & Cushman; IP Group of Pillsbury Madison & Sutro LLP

[57] ABSTRACT

A rotary anode type X-ray tube comprises a thin gas passageway extending from a lubricant chamber formed along the axis of a stationary structure and open at a fine gap G effective for preventing a lubricant leakage. In manufacturing the tube, a liquid metal lubricant is supplied to the lubricant chamber and to a slide bearing section, followed by assembling the tube and, then, sealing the assembled tube in a vacuum vessel. In the subsequent exhausting step, an open end of the gas passageway is allowed to face upward. The particular exhausting operation permits completely releasing to the outside the gas impregnated in the bearing-constituting members and the liquid metal lubricant, making it possible to maintain a stable bearing function.

10 Claims, 4 Drawing Sheets

ROTARY ANODE TYPE X-RAY TUBE AND METHOD OF MANUFACTURING THE SAME

BACKGROUND OF THE INVENTION

1. Field of the Invention

The present invention relates to a rotary anode type X-ray tube and a method of manufacturing the same.

2. Description of the Related Art

As known to the art, a rotary anode type X-ray tube comprises a rotary structure having a bearing section. The rotary structure is rotatably supported by a stationary structure. Also, a disk-like anode target is fixed to the rotary structure. In an X-ray tube of this construction, an electromagnetic coil of a stator arranged outside a vacuum vessel is energized so as to rotate the rotor fixed to the rotary structure. As a result, the anode target is rotated at a high speed together with the rotary structure. Under this condition, an electron beam emitted from a cathode is allowed to strike against the anode target rotating at a high speed so as to cause an X-ray emission.

The bearing section is formed of a roll bearing such as a ball bearing or a dynamic pressure type slide bearing utilizing a spiral groove formed in the bearing surface and a liquid metal lubricant filling a bearing gap, i.e., a gap between the outer surface of the stationary structure and the inner surface of the rotary structure. The liquid metal lubricant includes, for example, gallium (Ga) and a gallium-indium-tin (Ga-In-Sn) alloy. The rotary anode type X-ray tube comprising a dynamic pressure type slide bearing is exemplified in, for example, Japanese Patent Publication (Kokoku) No. 60-21463 (which corresponds to U.S. Pat. No. 4,210,371), Japanese Patent Disclosure (Kokai) No. 60-97536 (which corresponds to U.S. Pat. No. 4,562,587), Japanese Patent Disclosure No. 60-117531 (which corresponds to U.S. Pat. No. 4,641,332), Japanese Patent Disclosure No. 62-287555 (which corresponds to U.S. Pat. No. 4,856,039), Japanese Patent Disclosure No. 2-227948 (which corresponds to U.S. Pat. No. 5,068,885), Japanese Patent Disclosure No. 2-244545 (which corresponds to U.S. Pat. No. 5,077,776) and Japanese Patent Disclosure No. 2-227948 (which corresponds to U.S. Pat. No. 5,068,885).

In the rotary anode type X-ray tube disclosed in the prior art documents exemplified above, a fine bearing gap sized about, for example, 20 μm is provided in the dynamic pressure type slide bearing section having a spiral groove. These spiral groove and the bearing gap are filled with a liquid metal lubricant. Naturally, the lubricant is required to permeate over the entire region of the bearing gap in order to obtain a sufficient dynamic pressure for the slide bearing and, thus, to maintain a stable operation of the dynamic pressure type slide bearing. Where the lubricant fails to permeate over the entire region of the bearing gap, collision takes place between the outer surface of the stationary structure and the inner surface of the rotary structure in the worst case, with the result that the rotary structure is made incapable of rotation or is broken. To prevent such a problem, a lubricant chamber communicating with the bearing section is formed so as to ensure supply of a sufficient amount of a liquid metal lubricant to the bearing section even where the X-ray tube is operated over a long period of time.

In assembling the X-ray tube, a gas must be released completely from within the members constituting the bearing and from the lubricant. If the gas fails to be released sufficiently, the liquid metal lubricant is blown outside together with bubbles of the gas from the slide bearing section so as to be scattered within a vacuum vessel. In this case, the slide bearing fails to perform a stable dynamic pressure bearing function over a long period of time. Further, the liquid metal lubricant scattered within the vacuum vessel of the X-ray tube brings about a decisive defect that the withstand voltage of the apparatus is markedly impaired.

SUMMARY OF THE INVENTION

An object of the present invention is to provide a rotary anode type X-ray tube which permits releasing a gas completely from within the members constituting the bearing section and from a liquid metal lubricant in the exhausting step included in the assembling process of the X-ray tube, and which prevents the liquid metal lubricant from leaking out of the assembled X-ray tube so as to maintain a stable bearing function, as well as a method of manufacturing the same.

According to the present invention, there is provided a rotary anode type X-ray tube, comprising:

- a vacuum vessel having a vacuum space;
- a substantially columnar stationary structure mechanically supported within the vacuum vessel and located in the vacuum space;
- a substantially cylindrical rotary structure having an open end portion and rotatably fitted with the stationary structure with a bearing gap provided therebetween;
- an anode target fixed to one end of the rotary structure;
- a dynamic pressure type slide bearing section including a spiral groove formed on at least one of the stationary structure and the rotary structure;
- means for receiving a lubricant, which includes a lubricant chamber extending along the axis of the stationary structure and communicating with the slide bearing section, the liquid metal lubricant being applied to the receiving means and to the slide bearing section;
- means for preventing the lubricant from leaking out of the bearing section, the means being positioned between the stationary structure and the rotary structure on the side of the open end portion thereof to close the open end portion of the rotary structure and including a fine gap communicating with the bearing gap;
- means for defining an additional space connecting the fine gap of the preventing means to the space of the vacuum vessel; and
- gas-releasing means including a gas passage formed in the stationary structure such that the gas passage leads from the lubricant chamber to the additional space.

The present invention also provides a method of manufacturing a rotary anode type X-ray tube, the tube comprising: a vacuum vessel having a vacuum space; a substantially columnar stationary structure mechanically supported within the vacuum vessel and located in the vacuum space; a substantially cylindrical rotary structure having an open end portion and rotatably fitted with the stationary structure with a bearing gap provided therebetween; an anode target fixed to one end of the rotary structure; a dynamic pressure type slide bearing section including a spiral groove formed on at least one of the stationary structure and the rotary structure; means for receiving a lubricant, which includes a lubricant chamber extending along the axis of the stationary structure and communicating with the slide bearing section, the liquid metal lubricant being applied to the receiving means and to the slide bearing section; means for preventing the lubricant from leaking out of the bearing section, the means being positioned between the stationary structure and the rotary structure on the side of the open end portion thereof to close the open end portion of the rotary structure and including a fine gap communicating with the bearing gap; means for defining an additional space connecting the fine gap of the preventing means to the space of the vacuum vessel; and gas-releasing means including a gas passage formed in the stationary structure such that the gas passage leads from the lubricant chamber to the additional space;

the method comprising the steps of:

supplying a liquid metal lubricant to the lubricant chamber and to the slide bearing section;

sealing the assembled X-ray tube in a vacuum vessel; and exhausting the vacuum vessel with the open end of the gas passage formed in the stationary structure allowed to face upward.

In the present invention, the gas released from the members constituting the bearing section and from the liquid metal lubricant can be released without fail to the outside through the gas passageway leading from the lubricant chamber to the inner space of the vacuum vessel. As a result, the liquid metal lubricant can be prevented from leaking into the vacuum vessel both in the exhausting step and after manufacture of the X-ray tube. It follows that a stable bearing function can be maintained in the rotary anode type X-ray tube of the present invention.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
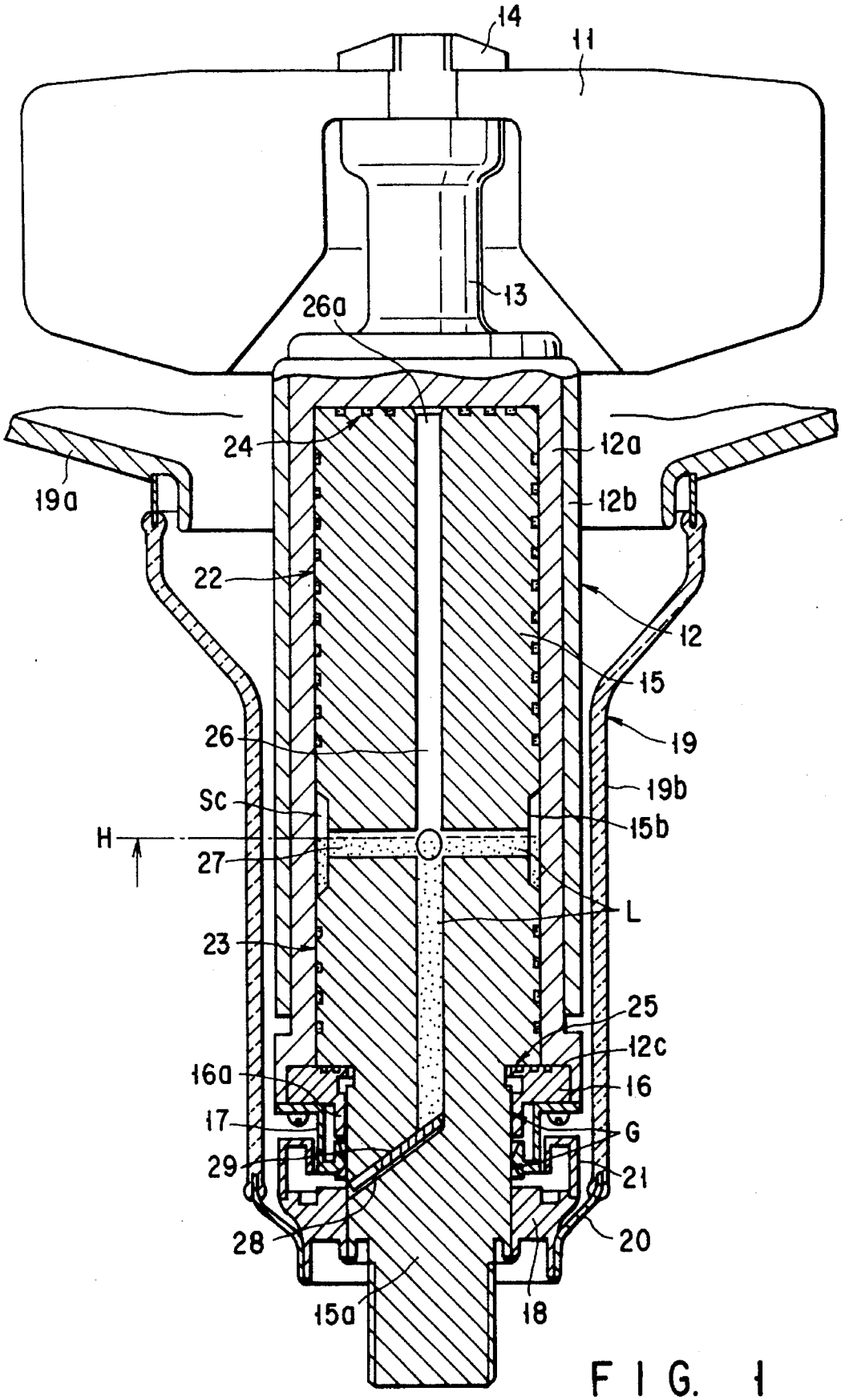
FIG. 1 is a cross sectional view schematically showing a rotary anode type X-ray tube according to one embodiment of the present invention.
Figure 2:
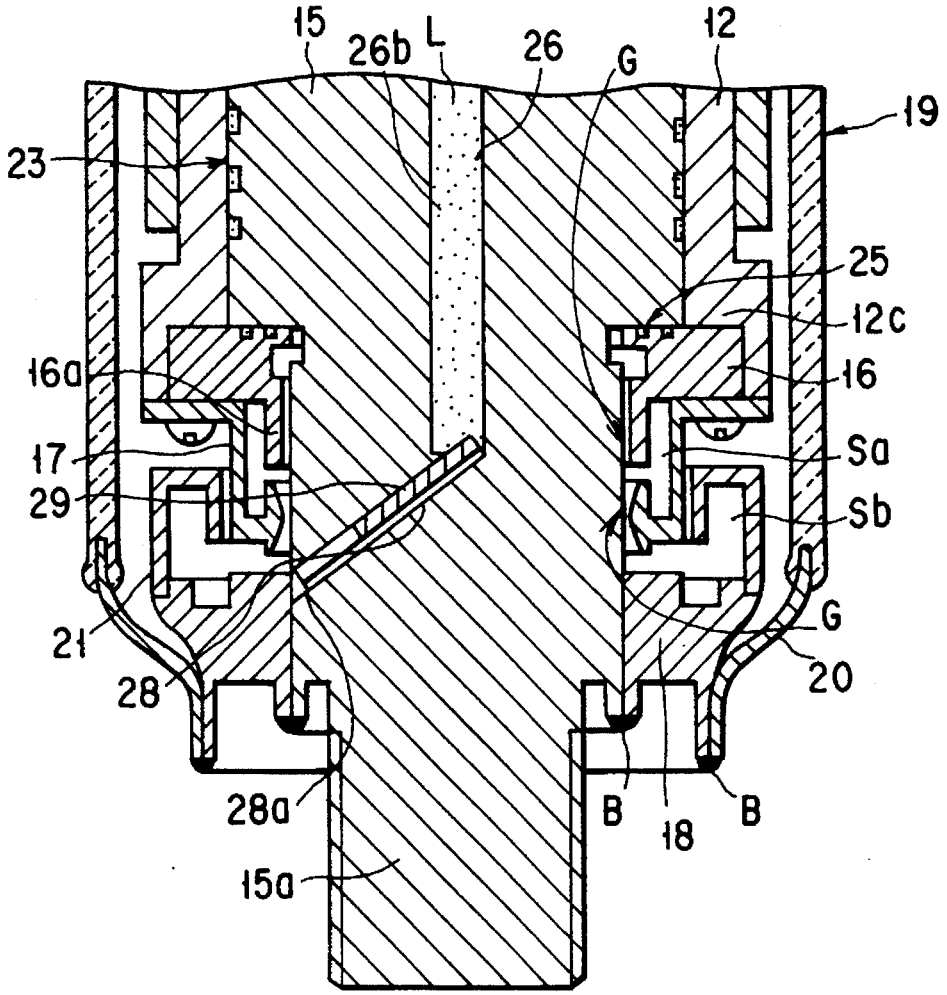
FIG. 2 is a cross sectional view showing in a magnified fashion a part of FIG. 1.

Let us describe a rotary anode type X-ray tube according to one embodiment of the present invention with reference to the accompanying drawings. Throughout these drawings, the same reference numerals denote the same members of the tube.

As shown in FIG. 1, a disk-like anode target 11 made of a heavy metal is integrally fixed by a nut 14 to a rotary shaft 13 mounted on one end of a cylindrical rotary structure 12 having a bottom. The rotary structure 12 is of a double-layer structure comprising an inner cylinder 12*a* made of an iron alloy and an outer cylinder 12*b* made of copper and fixed to the inner cylinder 12*a*. A substantially columnar stationary structure 15 made of an iron alloy is inserted into the rotary structure 12. The stationary structure 15 comprises a small-diameter portion 15*a* at the lower end portion facing a cylindrical end portion 12*c* of the rotary structure 12. Further, a thrust ring 16 substantially closing the opening of the cylindrical end portion 12*c* of the rotary structure 12 is integrally fixed to the cylindrical end portion 12*c* by a plurality of bolts.

The rotary structure 12 is fitted with the stationary structure 15, and vice versa. A dynamic pressure type slide bearing section including a spiral groove as described in the prior art documents referred to previously is formed between these structures 12 and 15. Specifically, two sets of radial slide bearing sections 22 and 23 each having a spiral groove of a herringbone pattern are formed a predetermined distance apart from each other in the axial direction along the outer circumferential surface of the stationary structure 15. Also formed are two sets of thrust slide bearing sections 24 and 25 each having a spiral groove of a circular herringbone pattern. Specifically, the thrust slide bearing section 24 is formed on one end surface, i.e., the upper surface in FIG. 1, of the stationary structure 15, with the other thrust bearing section 25 being formed on the upper surface of the thrust ring 16. During operation of the X-ray tube, a bearing gap of 20 to 30 μm is maintained between the two bearing surfaces, i.e., between the inner surface of the rotary structure and the outer surface of the stationary structure.

A cylindrical portion 16*a* is fixed to the thrust ring 16 in a manner to surround the small-diameter portion 15*a* of the stationary structure 15. A fine gap G which permits preventing a liquid metal lubricant from leaking to the outside is formed between the cylindrical portion 16*a* and the small-diameter portion 15*a* of the stationary structure 15. Further, a first trap ring 17 is fixed to the lower portion of the thrust ring 16 in a manner to face the small-diameter portion 15*a* of the stationary structure 15 with the fine gap G effective for preventing the leakage of the lubricant. A first trapping space Sa for trapping the lubricant is formed inside the first trap ring 17. These thrust ring 16 and first trap ring 17 are integrally fixed to the rotary structure 12 so as to form a closing structure for closing the open end of the rotary structure 12. In this embodiment, the thrust ring 16 and the first trap ring 17 are arranged to face each other, with the fine gap G effective for preventing the leakage of the lubricant being provided between the thrust ring 16 and the small-diameter portion 15*a* of the stationary structure 15 and between the first trap ring 17 and the small-diameter portion 15*a*, as already described. Further, the facing region between the thrust ring 16 and the first trap ring 17 extends along the entire circumferential region of the small-diameter portion 15*a*. The fine gap G noted above should be greater than the bearing gap in the slide bearing section, which is, for example, 20 to 30 μm. Specifically, the fine gap G should be not greater than 100 μm. If the fine gap G is larger than 100 μm, it is impossible to obtain a sufficient effect of preventing a liquid metal lubricant from leaking into the vacuum vessel.

A sealing auxiliary ring 18 is hermetically welded to the small-diameter portion 15*a*. Also, a sealing metal ring 20 of a vacuum vessel 19 is hermetically welded to the auxiliary ring 18. A second trap ring 21 serving to prevent the liquid metal lubricant from leaking to the outside is fixed to the auxiliary ring 18. Further, a second trapping space Sb for trapping the lubricant is formed inside the second trap ring 21. If the liquid metal lubricant should leak through the fine gap G, the leaking lubricant is trapped by these trapping spaces Sa and Sb formed inside these trap rings 17 and 21. Naturally, the lubricant is prevented from leaking into and being scattered within the vacuum vessel 19. Incidentally, the vacuum vessel 19 comprises a metal container portion 19*a* having a diameter large enough to surround the anode target 11, a glass container portion 19*b* having a small diameter and surrounding the rotary structure 12, an X-ray emitting window 19*d* made of beryllium and hermetically bonded to a predetermined position, and a glass container portion 19*c* on the side of a cathode.

A lubricant chamber 26 is formed in a central portion of the stationary structure 15 such that the chamber 26 extends along the axis of the stationary structure 15. An open end 26*a*, which is positioned in the upper end portion in FIG. 1, of the lubricant chamber 26 is connected to a central portion of the thrust slide bearing section 24, with the result that the lubricant chamber 26 communicates with the thrust slide bearing section 24. The stationary structure 15 comprises a small diameter portion 15*b* formed in a central portion. As shown in FIG. 1, an annular space Sc is defined by the small diameter portion 15*b* between the outer surface of the stationary structure 15 and the inner surface of the rotary structure 12. Four radial passage 27 leading from the lubricant chamber 26 to the annular space Sc are formed 90° apart from each other within the stationary structure 15. It follows that the lubricant chamber 26 communicates with the annular space Sc through the radial passage 27, and with the radial bearing sections 22 and 23 through the annular space Sc. Naturally, the lubricant flows from the lubricant chamber 26 into the radial bearing sections 22 and 23 through the radial passage 27 and the annular space Sc. In addition, these radial passage 27 and annular space Sc perform the function of a lubricant chamber.

Figure 3:
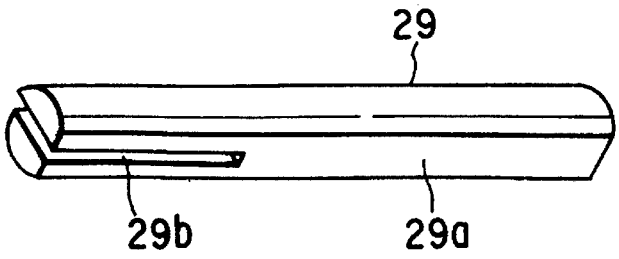
FIG. 3 is an oblique view showing in a magnified fashion the rod included in the apparatus shown in FIG. 1.

A gas passage 28 having a diameter of about 1.5 mm is formed within the stationary structure 15 such that the gas passageway 28 extends obliquely downward from a lower end portion 26*b* of the lubricant chamber 26 so as to be connected to the second trapping space Sb for trapping the lubricant. The second trapping space Sc, which is positioned downward of the fine gaps G described previously, communicates with the space within the vacuum vessel 19. A rod 29, which is shown in FIG. 3, is inserted into the gas passage 28. The rod 29 is made of, for example, molybdenum, copper or an iron alloy, which can be wetted well with a liquid metal lubricant, and has an outer diameter suitable for a tight engagement with the gas passage 28. The surface of the rod 29 is partly chamfered slightly to form a recessed portion 29*a*. Also, a slit 29*b* is formed in one end portion of the rod 29. It is possible to prepare the rod 29 by coating a core of an optional material with a film which can be wetted well with the liquid metal lubricant.

The rod 29 is inserted through an open end 28*a* into the gas passage 28 before the auxiliary ring 18 having the second lubricant trap ring 21 is welded to the small diameter portion 15*a* of the stationary structure 15. In this rod inserting step, the slit 29*b* of the rod 29 is slightly widened in advance to make the outer diameter of the rod in the end portion greater than the inner diameter of the gas passage 28. After the rod 29 is completely inserted into the gas passage 28, the slit 29*b* is brought back to the original state to achieve a tight engagement between the rod 29 and the gas passage 28. After insertion of the rod 29 into the gas passage 28, the auxiliary ring 18 is engaged with the outer surface of the small diameter portion 15*a* of the stationary structure 15, followed by applying a hermetic welding to welding portions B. The auxiliary ring 18 should be engaged with the outer surface of the small diameter portion 15*a* such that the open end 28*a* of the gas passage 28 is not completely closed so as to provide a small clearance for the gas passage. It follows that a small gas passage is defined between the inner wall of the gas passage 28 and the surface of the recessed portion 29*a* of the rod 29. Incidentally, the rod 29 need not be inserted into the gas passage 28, if it is possible to make the inner diameter of the gas passage 28 very small.

A liquid metal lubricant L such as a molten Ga alloy is supplied to the lubricant chamber 26, the radial passage 27, the annular space Sc, the spiral grooves of the bearing sections, and the bearing gaps included in the bearing sections. The lubricant L should be used in such an amount as to fill about 50% of the free inner space, which is equal to the sum of the volumes of these lubricant chamber, radial passage, annular space, spiral grooves and bearing gaps. Where the lubricant L is used in the amount mentioned, lower portions alone of the lubricant chamber 26 and the radial passage 27 are filled with the lubricant L as denoted by a letter H in FIG. 1, which shows that the anode target 11 is positioned in the upper portion. In this case, however, the lubricant L is sufficiently supplied to the spiral grooves and the bearing gaps included in the bearing sections. It is desirable for the amount of the lubricant L not to exceed about 80% of the free inner space.

Figure 4:
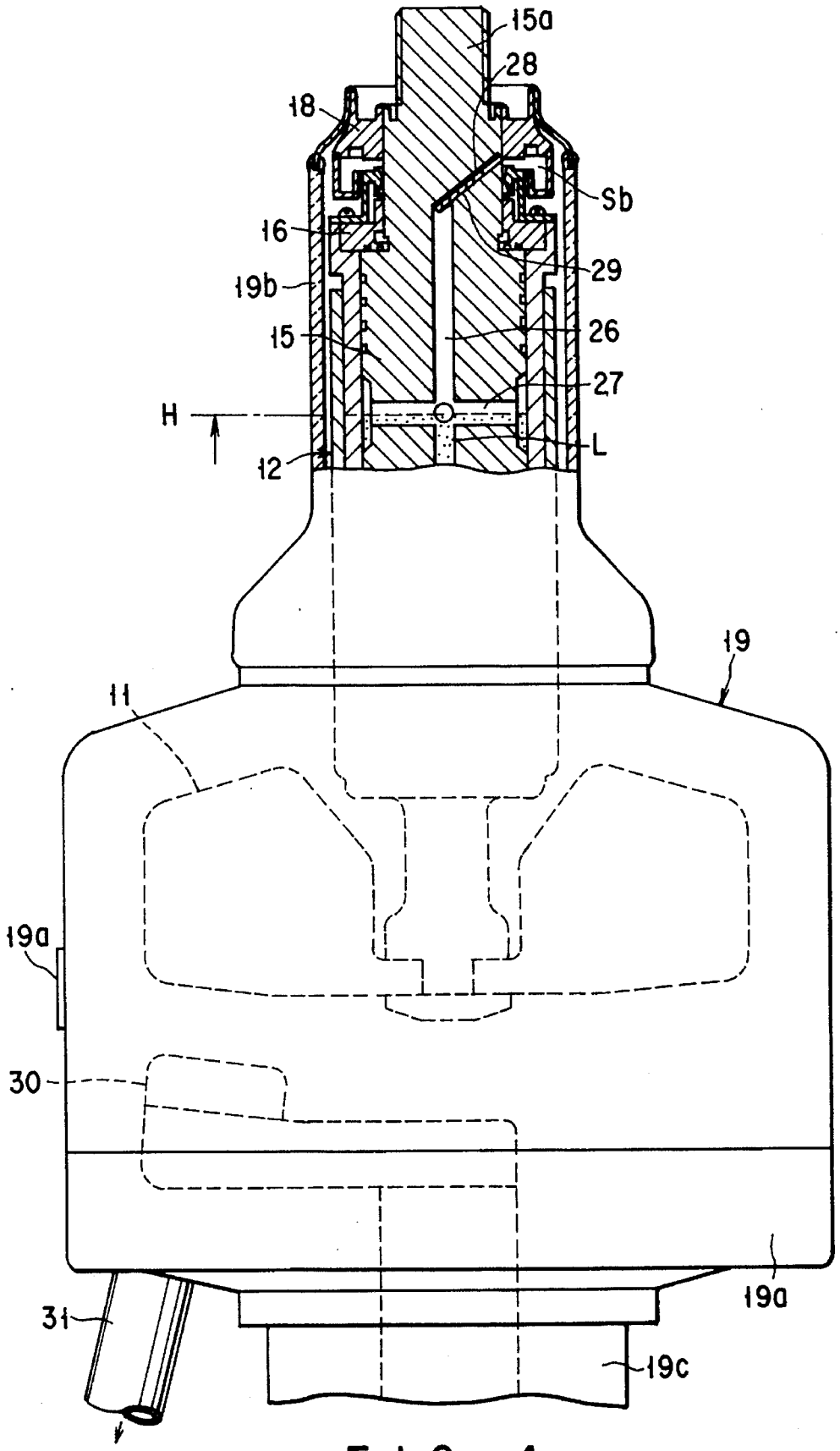
FIG. 4 is a side view showing in a magnified fashion how the X-ray tube shown in FIG. 1 is held in the exhausting step included in the manufacturing process of the apparatus.

The rotary anode structure thus assembled and a cathode structure 30 are incorporated in predetermined positions inside the vacuum vessel 19, followed by hermetically welding the sealing metal ring 20 of the vacuum vessel to the sealing auxiliary ring 18. Then, the X-ray tube is subjected to an exhausting step. In this step, the small diameter portion 15*a* of the stationary structure 15 is positioned in the upper portion. Under this condition, a metallic exhausting pipe 31 connected to a predetermined position on the cathode side of the metal container portion 19*a* of the vacuum vessel 19 is connected to a vacuum pump (not shown) in preparation for the exhausting operation, as shown in FIG. 4. The exhausting operation in this step is carried out without rotating the anode target 11, with the X-ray tube maintained at room temperature. Under this condition, the bearing gap in the upper thrust bearing section 25 is eliminated substantially completely by the weight of the anode target 11 so as to cause the rotary and stationary structures 12 and 15 to be brought into tight contact in the bearing surface. In this case, however, the radial passageways 27 are not completely filled with the lubricant L, as denoted by the liquid surface line H in FIG. 4. Naturally, the radial passage 27, that portion of the lubricant chamber 26 which is located above the liquid surface line H, and the gas passage 28 are not filled with the lubricant L. It follows that the gas generated inside the stationary structure 15 can be released to the outside through these radial passageways 27, etc. Naturally, the gas bubbles generated from within the bearing sections, the lubricant chamber 26, etc. can be released effectively to the outside through the gas passage 28 without bringing about leakage of the lubricant.

The anode target 11 is not rotated during the exhausting step described above. As described above, the bearing surfaces of the upper thrust bearing section 25 are in tight contact during the exhausting operation. It follows that, if the anode target is rotated, a severe friction or biting takes place in the bearing surface. As a result, the anode target cannot be rotated smoothly. Also, the bearing surfaces are likely to be broken.

Figure 5:
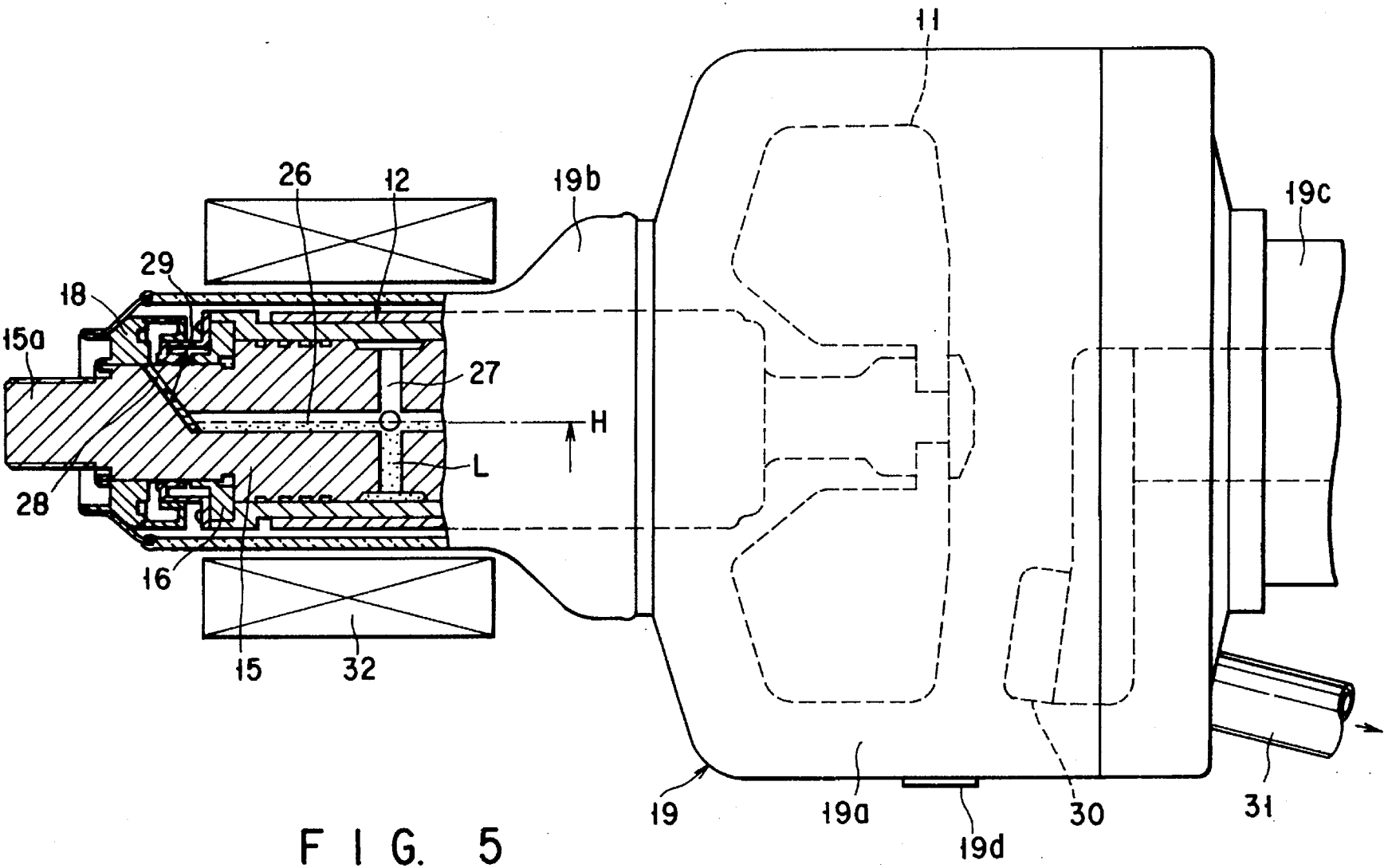
FIG. 5 is a front view showing in a magnified fashion how the X-ray tube shown in FIG. 1 is held in the exhausting step included in the manufacturing process of the apparatus.

In a latter part of the exhausting step, the X-ray tube is laid down such that the open end of the gas passage 28 is positioned obliquely upward of the lubricant chamber 26, as shown in FIG. 5. In this step, the anode target 11 is maintained at room temperature and is not rotated during the exhausting operation. It should be noted that the lubricant surface line H extends substantially along the center in the vertical direction of the lubricant chamber 26. In other words, the lubricant chamber 26 is not completely filled with the lubricant L, making it possible to release sufficiently the gas which was not released to the outside under the condition shown in FIG. 4. Of course, the lubricant leakage does not take place during the gas exhausting step. What should also be noted is that, since the X-ray tube is laid down, the lubricant within the tube is allowed to permeate into other spiral grooves and bearing gaps included in the bearing sections.

Where the anode target is relatively light in weight, it is possible to continue the exhausting operation, with the X-ray tube laid down at room temperature. In this case, an alternating current is supplied to a stator coil 32 wound around that region of the outer circumferential surface of the vacuum vessel 19 which faces the rotary structure 12. As a result, the rotary structure 12 is gradually rotated by an alternating field generated from the stator coil 32. The rotation causes the lubricant L to permeate over the entire region of the bearing sections so as to wet the bearing surfaces. If the speed of rotation is gradually increased, a stable lubricating function can be obtained without bringing about biting of the bearing surfaces. It is desirable to continue the exhausting operation by continuously rotating the anode target 11 at a speed of, for example, about 3,000 rpm.

It is desirable to apply heating to the X-ray tube in the exhausting step, because the heating facilitates the gas generation from the members of the X-ray tube. In the case of rotating the anode target, however, it is necessary to prevent over-heating of the stator coil. This makes it difficult to perform the exhausting operation while applying an external heating to heat the members of the X-ray tube provided with the stator coil to temperatures higher than, for example, 300° C. In practice, it is desirable not to mount the stator coil. In this case, the exhausting operation should be continued while heating the members of the X-ray tube provided with no stator coil to temperatures higher than, for example, 400° C. by utilizing an external heating means. The heating applied in this fashion is effective for generating gas from, for example, the bearing sections of the manufactured X-ray tube.

Alternatively, the heating from an external heat source may be omitted in the exhausting step which is performed with the X-ray tube laid down. In this case, the exhausting operation should be continued while allowing an electron beam emitted from the cathode structure to strike against the anode target which is kept rotated so as to maintain high temperatures of the members of the anode structure. However, where the anode target is considerably heavy, it is difficult to rotate the anode target in the exhausting step with the X-ray tube laid down. It should be noted that, where the anode target is considerably heavy, the bearing gap in, particularly, the radial bearing section is eliminated by the weight of the anode target. In other words, the mutually facing bearing surfaces are brought into direct contact with each other, with the lubricant released from the bearing gap. If the anode target is rotated under this condition, strong friction and biting take place in the bearing surfaces so as to do damages to the bearing surfaces.

After completion of the exhausting operation applied at room temperature to the X-ray tube which is laid down, the tube is allowed to stand upright as shown in FIG. 4. Under this condition, an electric power is supplied to the stator coil 32 arranged to surround the rotary structure 12 so as to gradually rotate the anode target 11 while continuing the exhausting operation at room temperature. It should be noted that, during the previous exhausting step applied to the tube which is laid down, lubricant is supplied to some extent to the spiral groove and the bearing gap of the thrust bearing section positioned in the upper region, with the result that the rotation of the anode target 11 is started smoothly. Since the rotary structure 12 is rotated with the tube held upright, the lubricant is allowed to permeate over the entire required region of the tube. In addition, the gas generated from within the tube can be released to the outside without bringing about leakage of the lubricant.

In the exhausting step with the tube held upright, it is possible to apply heating from an external heat source for the heating to temperatures higher than, for example, 400° C. In this case, the stator coil 32 is not mounted. It should be noted that the gas bubbles generated from, for example, the bearing sections and the lubricant chamber 26 can be efficiently released in this step to the outside through the gas passage 28. Further, the gas bubbles generated from or passing through the lubricant chamber 26 do not pass through the fine gap G formed between the cylindrical portion **16*a* of the thrust ring 16 and the outer surface of the small diameter portion 15a of the stationary structure 15. Specifically, these gas bubbles are guided directly into the inner space of the vacuum vessel 19 through the gas passage 28** and, then, released to the outside by a vacuum pump. It follows that the gas alone generated from the bearing sections can be released efficiently to the outside without bringing about leakage of the lubricant.

Alternatively, it is possible to continue the exhausting operation with the X-ray tube held upright. In this case, an electron beam emitted from the cathode structure is allowed to strike against the anode target 11, which is kept rotated, so as to maintain high temperatures of the members of the anode structure.

Where the exhausting operation is applied to the X-ray tube, which is laid down as shown in FIG. 5, the tube should be heated by heating from an external heat source without rotating the anode target 11, or by an electron beam bombardment to the anode target 11, which is kept rotated. The heating allows the gas generated from within the X-ray tube to be released to the outside more efficiently.

Some of the various steps described above can be employed in combination, as desired, for achieving an effective release of the gas from within the X-ray tube, and for achieving lubricant supply to required regions effectively. Particularly, in the exhausting step during which an electron beam is allowed to strike against the anode target, it is desirable to perform the exhausting operation while locally cooling a region of the X-ray emitting window **19*d* made of beryllium so as to protect the X-ray emitting window 19*d*** and its hermetically welded portion.

In the final stage of the exhausting step, the exhausting pipe 31 is tip off under a sealed condition to achieve a suitable aging, thereby completing the manufacture of the X-ray tube. If the gas contained in the bearing-constituting members and in the lubricant is sufficiently removed in the exhausting step, a gas release does not take place during operation of the manufactured X-ray tube. Naturally, it is possible to prevent the lubricant from being pushed by the generated gas and, thus, to prevent the lubricant from leaking to the outside, leading to a high reliability of the X-ray tube.

It should be noted that the lubricant housed in the lubricant chamber 26 possibly enters the gas passage 28 during the exhausting step, the aging step, etc. so as to carry out reactions with the inner surface of the gas passage. Where the rod 29 is inserted into the gas passage 28, the lubricant also carries out reactions with the outer surface of the rod 29. These reactions proceed gradually, with the result that the reaction product is precipitated so as to close the gas passage 28. It follows that it may be possible to prevent without fail the liquid metal lubricant housed in the lubricant chamber 26 from leaking to the outside directly through the gas passage 28 during operation of the X-ray tube.

As already described, fine gaps G effective for preventing the lubricant leakage are formed between the stationary structure 15 and the rotary structure 12 in the open side end portion of the tube. These fine gaps G should be apart from each other in the axial direction of the tube. In the case of forming a plurality of fine gaps G, it is necessary for at least one fine gap G to be positioned in a region between the open end 28*a* of the gas passage 28 and the dynamic pressure slide bearing 25 which is located closest to the open end 28*a* among the bearings included in the tube. The fine gap G positioned in the particular region permits suppressing the lubricant leakage from the slide bearing section more effectively.

The metal lubricant used in the present invention includes a Ga-based material such as Ga metal, Ga-In alloy or Ga-In-Sn alloy. It is also possible to use a bismuth (Bi)-based alloy such as Bi-In-Pb-Sn alloy and an indium (In)-based alloy such as In-Bi alloy or In-Bi-Sn alloy. Since these materials have a melting point higher than room temperature, it is desirable to preheat the metal lubricant to temperatures higher than the melting point before the anode target is rotated.

As described in detail, the gas contained in the bearing-constituting members and in the liquid metal lubricant is released to the outside in the exhausting step through the gas passage leading from the lubricant chamber to the inner space of the vacuum vessel. What should be noted is that the lubricant leakage does not accompany the exhausting step, making it possible to maintain a stable bearing function. In addition, the rotary anode type X-ray tube of the present invention is substantially free from undesirable phenomena such as discharge occurrence within the tube.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A rotary anode type X-ray tube, comprising:

a vacuum vessel having a vacuum space;

a substantially columnar stationary structure mechanically supported within said vacuum vessel and located in the vacuum space;

a substantially cylindrical rotary structure having an open end portion and rotatably fitted with said stationary structure with a bearing gap provided therebetween;

an anode target fixed to one end of said rotary structure;

a dynamic pressure type slide bearing section including a spiral groove formed on at least one of the stationary structure and the rotary structure;

means for receiving a lubricant, which includes a lubricant chamber extending along the axis of the stationary structure and communicating with the slide bearing section, the liquid metal lubricant being applied to said receiving means and to the slide bearing section;

means for preventing the lubricant from leaking out of the bearing section, said means being positioned between the stationary structure and the rotary structure on the side of the open end portion thereof to close the open end portion of the rotary structure and including a fine gap communicating with the bearing gap;

means for defining an additional space connecting the fine gap of said preventing means to the space of said vacuum vessel; and gas-releasing means including a gas passage formed in the stationary structure such that said gas passage leads from the lubricant chamber to the additional space.

2. The tube according to claim 1, wherein a rod having a surface readily wettable with said liquid metal lubricant is inserted into said gas passage so as to define a fine space between the inner surface of the gas passage and the outer surface of said rod.

3. The tube according to claim 1, wherein said liquid metal lubricant is loaded in a free inner space including the lubricant chamber, and slide bearing sections in an amount not exceeding 80% of the volume of said free inner space.

4. The tube according to claim 1, wherein said defining means includes a first member fixed to said stationary structure and surrounding said rotary structure to define the additional space.

5. The tube according to claim 4, wherein said defining means includes a second member fixed to said preventing means and surrounding said rotary structure to define a second additional space communicated with the fine gap of said preventing means and said first member has a tip end surface faced to said rotary structure with a second fine gap which connects intermediate additional space to the first additional space.

6. A method of manufacturing a rotary anode type X-ray tube, said tube comprising: a vacuum vessel having a vacuum space; a substantially columnar stationary structure mechanically supported within said vacuum vessel and located in the vacuum space; a substantially cylindrical rotary structure having an open end portion and rotatably fitted with said stationary structure with a bearing gap provided therebetween; an anode target fixed to one end of said rotary structure; a dynamic pressure type slide bearing section including a spiral groove formed on at least one of the stationary structure and the rotary structure; means for receiving a lubricant, which includes a lubricant chamber extending along the axis of the stationary structure and communicating with the slide bearing section, the liquid metal lubricant being applied to said receiving means and to the slide bearing section; means for preventing the lubricant from leaking out of the bearing section, said means being positioned between the stationary structure and the rotary structure on the side of the open end portion thereof to close the open end portion of the rotary structure and including a fine gap communicating with the bearing gap; means for defining an additional space connecting the fine gap of said preventing means to the space of said vacuum vessel; and gas-releasing means including a gas passage formed in the stationary structure such that said gas passage leads from the lubricant chamber to the additional space;

said method comprising the steps of:

supplying a liquid metal lubricant to the lubricant chamber and to the slide bearing section;

sealing the assembled X-ray tube in a vacuum vessel; and exhausting said vacuum vessel with the open end of said gas passage formed in the stationary structure allowed to face upward.

7. The method according to claim 6, wherein the exhausting operation is started with the open end of said gas passage allowed to face upward and is further continued with the axis of rotation of the anode held horizontal or oblique.

8. The method according to claim 6, wherein said anode target is rotated during the exhausting operation.

9. The method according to claim 6, wherein the temperature of the bearing-constituting members is increased during the exhausting operation by external heating or electron beam impingement against said anode target.

10. The method according to claim 6, wherein the anode target is rotated during the exhausting operation.

* * * * *